US006604978B1

(12) United States Patent
Abel

(10) Patent No.: US 6,604,978 B1
(45) Date of Patent: Aug. 12, 2003

(54) TOP TOY

(76) Inventor: Jeffrey T. Abel, P.O. Box 895, Evanston, WY (US) 82931

( * ) Notice: Subject to any disclaimer, the term of this patent is extended or adjusted under 35 U.S.C. 154(b) by 0 days.

(21) Appl. No.: 10/241,315

(22) Filed: Sep. 10, 2002

(51) Int. Cl.[7] ..... A63F 9/00

(52) U.S. Cl. ..... 446/243; 446/255; 446/256; 273/109

(58) Field of Search ..... 446/236, 243, 446/255, 256, 259; 273/109, 342, 412

(56) References Cited

U.S. PATENT DOCUMENTS 3,408,766 A * 11/1968 Ajero ..... 446/255
3,591,181 A * 7/1971 Stewart ..... 273/412
3,933,356 A * 1/1976 Torgow ..... 273/108
5,683,083 A * 11/1997 Karabekian et al. ..... 473/569

* cited by examiner

*Primary Examiner*—Jacob K. Ackun
(74) *Attorney, Agent, or Firm*—Thorpe North & Western, LLP

(57) ABSTRACT

A top toy comprises a hand-held paddle with a contact portion and a handle portion, designed to manipulate, catch and throw a spinning top. The toy has two or more sides configured with substantially flat contact surfaces meeting at a periphery juncture to define an acute angle, such that the spinning top may be scooped or lifted from another surface onto the contact portion. The contact portion includes a perimeter ridge having a gap adjacent the handle, to enable a user to direct the spinning top onto the handle portion, to thereby manipulate, catch, or throw the spinning top from either the contact portion or the handle. The top and/or paddle may be constructed from or covered with glowing or glow-in-the-dark materials or substances to cause the top and/or paddle to glow in the dark, or provide enhanced visibility in daylight.

20 Claims, 2 Drawing Sheets

TOP TOY

BACKGROUND OF THE INVENTION

1. Field of the Invention

The present invention is directed to spinning tops and devices designed to be used with them. In particular, the present invention is directed to a top and a specifically configured paddle designed for performing tricks with, throwing and/or catching, and picking up a spinning top.

2. Related Art

Spinning tops have been known and used for hundreds of years. Over time, a variety of games and accessories have been devised for use with spinning tops. Some of these include platforms or other devices, either stationary or hand-held, for supporting a spinning top. Some involve a game board upon which a top may be propelled, manipulated, or guided to direct its path, and may include various paths or passageways through which the spinning top may travel to upset target pins or other objects. Still others provide a handheld paddle device with opposing sides that provide different levels of difficulty for manipulating, catching and/or throwing a spinning top. Some of these devices may include means for storing one or more tops in removable relation to the paddle, and may be constructed of day-glow or glow-in-the-dark materials to allow their use in the dark or provide greater visibility in daylight.

However, prior art top-related devices present limitations on how the spinning top may be manipulated, thrown, caught, etc. It would be desirable to have an interactive paddle device designed for hand-held support and manipulation, such as to throw and catch a spinning top, which is capable of a greater range of manipulation of the top, and provides more challenge than prior devices.

SUMMARY OF THE INVENTION

It has been recognized that it would be desirable to have a top toy device designed and configured to manipulate, catch and/or throw a spinning top while maintaining the spinning action of the top, while also providing a greater range of manipulation for the top, and more challenge than prior devices.

It would also be desirable to have a toy top and paddle game apparatus configured to allow a user to pick up, support, throw, and catch a spinning top using either the handle or the contact portion of the paddle.

It would also be desirable to have a two-part, unattached interactive top toy that can be played in darkness, or that enhances visual observation in daylight.

It would also be desirable to provide a top-paddle toy having opposing faces of the paddle which provide different levels of difficulty for manipulating, catching and throwing the top.

The present invention provides a hand-held top toy game apparatus that includes a top configured for spinning, and a paddle, configured for manipulating, catching, and throwing the spinning top. The paddle has a handle for gripping by a user, and a contact portion connected to the handle. The contact portion has a plurality of sides, the juncture of two sides defining a periphery, with a ridge disposed along at least a length of the periphery of at least one side. The ridge defines a gap adjacent to the connection of the handle and the top side of the contact portion, such that the spinning top may travel from the top side of the contact portion onto the handle portion. The handle portion may further be adapted with means for holding or storing one or more tops.

The periphery of the contact portion is adapted with a terminal edge forming an acute angle between the bottom side of the contact surface and the top side of the top contact surface. Because the terminal edge is an acute angle, it is possible to use the terminal edge to lift the spinning top from another surface onto the top contact surface. The top side may have a recessed dimple therein, in the contact portion and/or the handle. The bottom side of the contact surface is substantially flat with no prominent depressions or outwardly extending structures, but may also have a recessed dimple therein. The top-paddle toy device of the present invention may be constructed from day-glow or glow-in-the-dark materials.

Additional features and advantages of the invention will be apparent from the detailed description which follows, taken in conjunction with the accompanying drawings, which together illustrate, by way of example, features of the invention.

DETAILED DESCRIPTION

Figure 1:
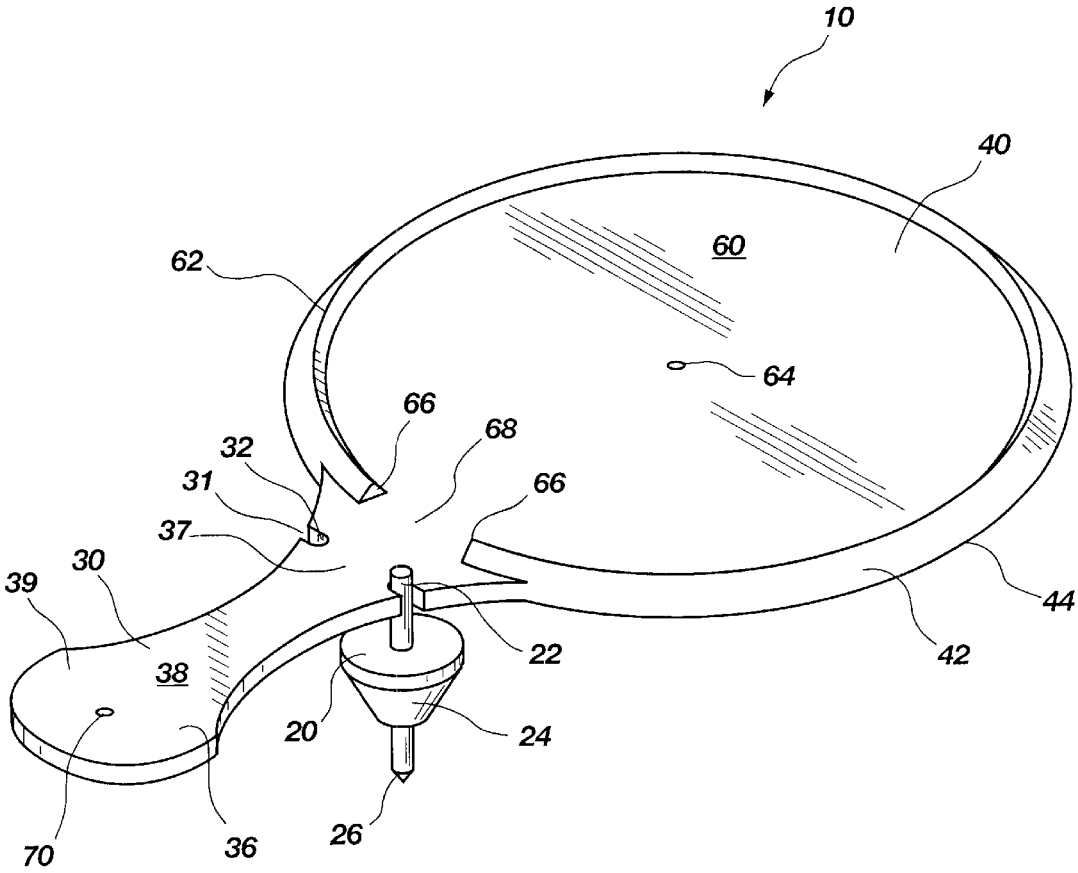
FIG. 1 is a perspective view of one embodiment of the present invention having differing bottom and top contact surfaces.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention is a top-paddle toy 10. The top and paddle are designed for construction from day-glow and/or glow-in-the-dark materials. The toy 10 comprises a handle portion 30 and a contact portion 40, that is, a portion which in use is primarily intended for contact by a spinning top. The toy is configured such that the user may grasp it by the handle portion, to manipulate it as desired.

As illustrated in the Figures, the handle portion 30 comprises an elongate member 38 having a first or distal end 37 and a second or proximal end 39. The elongate member is of sufficient length between the distal end and proximal so as to enable the user to be able to grasp the handle to control and manipulate the toy. The handle portion 30 can be configured as a substantially flat handle as shown in the Figures. Alternative equivalent embodiments would include handle portions that are more rounded in cross-section (not shown). Additionally, the handle could be configured with a hollow interior (not shown) to provide means for storing and/or retaining tops. The handle portion 30 could be configured of a myriad of shapes and thicknesses, so long as the user is provided a suitable location at which to grasp and control the paddle. For example, the handle portion need not necessarily comprise a protruding member 38. The handle portion can be any structure suitably adapted to enable the user to grasp and control the device with one hand, if desired.

The toy 10 is adapted with means 31 for retaining and storing one or more tops 20. The tops generally comprise a stem 22, a body 24 and a contact point 26. The retaining means 31 may be disposed on the elongate member 38 near the distal end 37, or may be located elsewhere on the paddle 10. In one embodiment, the retaining means comprises one or more inwardly extending recesses formed by sidewalls 32 adapted to receive and retain by friction or snap fit the stem 22 of one or more tops 20. The sidewalls 32 form one or more storage alcoves for the convenient carrying or storage of one or more tops 20. It is also contemplated that other embodiments of retaining means 31 could extend out from, rather than be recessed into, the handle portion 30, so long as they do not interfere with the ability of the user to grasp the handle portion and control and manipulate the toy. The function of the retaining means 31 is to retain and store tops 20. The tops neither spin in nor are spun by any mechanism located in the retaining means.

Figure 2:
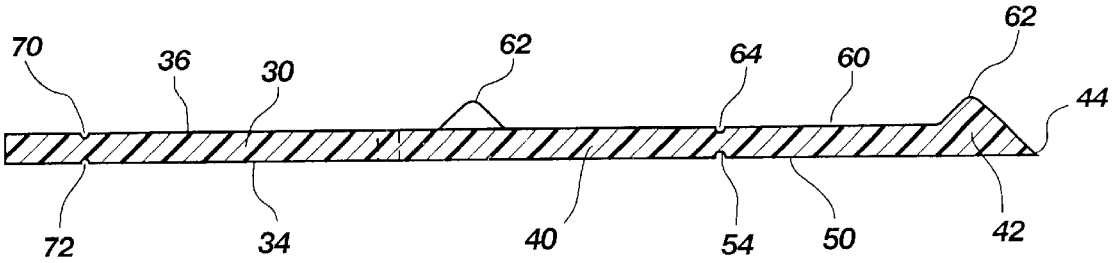
FIG. 2 is a cross-sectional view of the embodiment of FIG. 1.

FIGS. 1 and 2 also illustrate one embodiment of the contact portion 40. The contact portion may comprise a bottom contact surface 50 on one side, and a top contact surface 60 on the other side. The contact portion further comprises a periphery boundary 42 terminating in a terminal edge 44. The bottom contact surface 50 and top contact surface 60 converge at a periphery juncture at an acute angle. In one embodiment, the acute angle is between about 5°–45°. To prevent injury to the user, the edge 44 is configured with a rounded radius between about 15–50 thousandths of an inch. As will be appreciated, the thickness of the contact surface near the juncture of the converging surfaces must be such that it does not collide with a stem 22 or body 24 of a top 20, thereby compromising the spin of the top.

The relationship between contact surfaces meeting to form edge 44 is best configured so that when the edge is employed to urge a spinning top onto a contact surface, a portion of the receiving contact surface is substantially parallel with the surface from which the spinning top is being urged. If receiving contact surface 40 is not substantially parallel to the surface from which the spinning top is being urged, a portion of the top will collide with the contact surface, compromising the spin of the top. The edge 44 enables a user to urge a spinning top from another surface onto the contact portion 40 by scooping or lifting the spinning top from another surface, onto the contact portion at the edge. Similarly, the edge 44 permits the spinning top to leave the contact surface as desired by the user. In a preferred embodiment, the edge may circumscribe substantially all of the periphery 42 of contact portion. However, it is contemplated that the edge having an acute angle may traverse only a portion of the periphery 42.

The bottom contact surface 50 is contemplated as being substantially flat except for one or more dimples 54. The dimple is contemplated as being about one-sixteenth of an inch in diameter with a depth of about one-thirty second of an inch. The dimple provides additional challenge in manipulating the spinning top in and out of the dimple. Because the contact surface 50 is substantially flat, having no prominent raised portions to help keep a spinning top thereon, catching and retaining a spinning top on this surface requires more advanced dexterity and skill.

The top substantially flat contact surface 60 further comprises a ridge 62 disposed around at least a portion of the periphery. The ridge may be rounded on its top edge to provide a surface over which a spinning top may traverse as it is scooped onto the top contact surface, and moves toward the dimple 64, or vice-versa. The ridge may be configured with a smooth transition to permit the spinning top to traverse up, down and over ridge 62. The ridge assists the less advanced user to catch and manipulate the spinning top on contact portion 40 because the ridge helps maintain the top on the top contact surface. This is particularly useful to the user when catching a spinning top. In one embodiment, the ridge is substantially coextensive with the periphery boundary 42.

The ridge 62 may also comprise terminal ends 66 defining a gap 68 adjacent to the location of connection of the handle 30 to the contact portion 40. In the embodiments shown, the size of the gap may be about one inch wide, for example, though other widths may also be used, or multiple gaps may be provided. This configuration allows a spinning top 24 to travel from the top contact surface 60 of the contact portion onto the flat top surface 36 of the handle portion 30. This configuration provides a greater range of manipulation for the top, and more challenge than prior devices because it allows a user to pick up, support, throw, and catch a spinning top using the relatively narrow handle portion, in addition to the contact portion of the paddle. Advantageously, the handle portion may also include a dimple 70 to further challenge the user.

Figure 3:
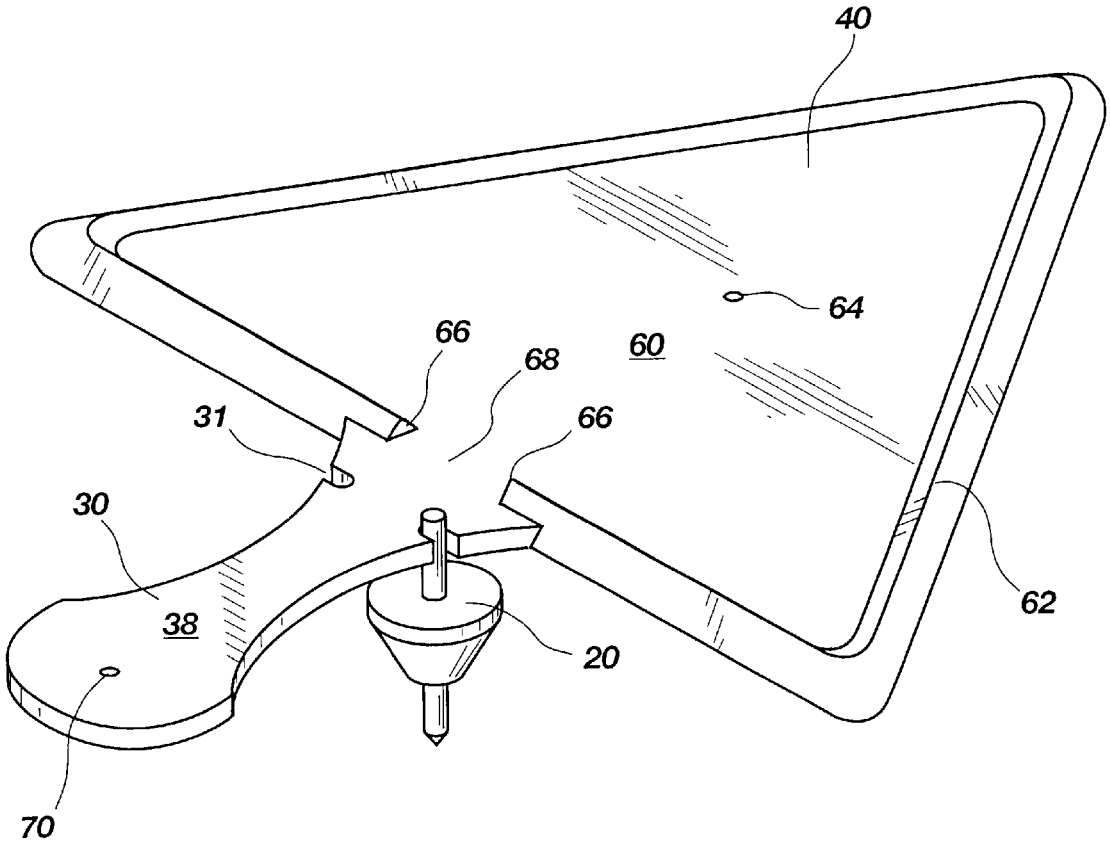
FIG. 3 is a perspective view of an alternative embodiment of the present invention.

Other embodiments could also be devised to permit the periphery and/or ridge 62 to be any one of a variety of shapes, sizes, or heights suited to assist or challenge the ability of the user to manipulate, throw and/or catch spinning tops. For example, contact portion 40 and periphery boundary 42 could be triangle-shaped with a corresponding triangle-shaped ridge 62, as shown in FIG. 3. Different geographic adaptations of the contact portion 40, periphery boundary 42 and ridge 62 are also contemplated. The present invention also contemplates having intermittent ridges (not shown). The top contact surface 60 may also comprise one or more dimple(s) 64.

As shown in FIG. 2, the handle portion 30 has a bottom side 34 and a top side 36. The bottom side 34 may be substantially co-planar with the bottom side 50 of the contact portion 40. In other words, there is little or no transition between the bottom contact side 50 and the bottom handle side 34, and a spinning top on the bottom side can easily travel onto the handle portion. One or more dimples 72 may be provided on the bottom side 34 of the handle for additional challenge to a user. On the other hand, the top side 36 of the handle portion 30 and the top side 60 of the contact portion 40 include the ridge 62. The gap 68 in the ridge may be made small or large, to require different levels of skill in manipulating a spinning top onto the handle portion on the top side. Consequently, the use of the bottom contact surface generally 50 requires more skill and attention to maintain the spinning top in contact with toy 10.

While one embodiment of the present invention provides a bottom surface 50 and a top surface 60 to accommodate differing skill levels of users, the present invention also contemplates an alternative embodiment configured with two flat surfaces 50, without a ridge-bounded surface 60. Similarly, the present invention also contemplates an alternative embodiment configured with two ridge-bounded surfaces 60, without a flat surface 50. Still further, the present invention also contemplates more than two substantially flat contact surfaces, such as three or four, such that toy 10 has a more pronounced 3-dimensional shape. In such an embodiment, each side can be used by manipulating the user's grip on or about handle portion 30. In the case of alternative embodiments, each alternative embodiment may also include one or more of the additional features discussed above, such as the edge 44 having an acute angle where the surfaces meet at periphery 42, or the presence of means 31 for retaining and/or storing static tops.

Either the top 20 or the paddle 10, or both the top and the paddle, may be constructed from materials that radiate light or enhance or concentrate reflected light. For example, one or more components may be manufactured using materials known by those skilled in the art to effectively host glow-in-the-dark material, such as glow-in-the-dark plastic. Constructing the top and/or paddle from glow-in-the-dark materials permits use of the toy in darkness. Because the top is not tethered to the paddle, the top paddle device of the present invention defines a two-part, unattached configuration. This permits use by an individual alone, or a game of throwing the top, or tops, between multiple users, even in darkness. Of particular advantage is the construction of the top using glow-in-the-dark materials so that if or when the top is dropped in dark conditions, the top is easily found and can be readily put back into play so that tossing and catching with the paddle may resume.

Similarly, the top and/or paddle may be constructed of commonly known day-glow material which enhances or concentrates reflected day or room light to edges or other portions of the top and/or paddle, thereby increasing the visual brightness of components of the present invention. Still further, the top and/or paddle can be constructed of any suitable material that will receive glow-in-the-dark paints or other substances, such as substances that illuminate when exposed to infrared or ultraviolet light/radiation. Any ability of the top and/or paddle, or their treated surfaces, to radiate or reflect light, even temporarily, is referred to herein as glowing or to glow.

The toy 10 may be used by one user to manipulate, toss and catch a spinning top. A more challenging and interactive game contemplates play by more than one person, each person having a paddle 10, whereby each person throws to and catches from another person the spinning top. A still more challenging game is played when more than one top is being tossed or caught by the participants. Use of the device in darkness is particularly challenging and amusing. When more than one person is catching, manipulating and/or throwing one or more tops, the benefit of having the ridge 62 can be a significant help in maintaining control of the moving top, and in maintaining the top on the top contact surface 60.

It is to be understood that the above-referenced arrangements are illustrative of the application of the principles of the present invention. Numerous modifications and alternative arrangements can be devised without departing from the spirit and scope of the present invention, which has been shown in the drawings and described above in connection with certain exemplary embodiments(s). It will be apparent to those of ordinary skill in the art that numerous modifications can be made without departing from the principles and concepts of the invention as set forth in the claims.

What is claimed is:

1. A hand-held top toy apparatus, comprising:

a top, configured for spinning;

a paddle, configured for manipulating, catching, and throwing the spinning top, comprising:

a handle portion;

a contact portion connected to the handle portion, the contact portion having:

(i) a plurality of sides, the juncture of two sides defining a periphery; and (ii) a ridge, disposed along at least a length of the periphery of at least one side, the ridge having terminal ends defining a gap adjacent the connection of the handle and the contact portion, whereby the spinning top may travel from the contact portion, through the gap, and onto the handle portion.

2. The apparatus of claim 1, wherein the ridge is sloped along at least a length of the periphery.

3. The apparatus of claim 1, further comprising means for retaining and storing tops.

4. The apparatus of claim 1, further comprising a dimple on the at least one side of the contact portion.

5. The apparatus of claim 1, further comprising a dimple on a side of the handle portion contiguous with the at least one side of the contact portion.

6. The apparatus of claim 1, wherein at least one of the handle portion, the contact portion, and the top are constructed of material which is capable of glowing.

7. The apparatus of claim 1, wherein the juncture of two sides and the ridge defines an acute angle capable of urging the spinning top onto the contact portion from another surface.

8. A hand-held toy used to manipulate, catch and throw a spinning top, the toy apparatus comprising:

a handle portion; and a contact portion, connected to the handle portion, the contact portion including:

(i) a plurality of sides, each side defining a periphery, and (ii) a ridge, disposed along at least a length of the periphery of at least one side, the ridge having terminal ends defining a gap adjacent the connection of the handle and the contact portion, whereby a spinning top may travel from the contact portion through the gap and onto the handle portion.

9. The apparatus of claim 8, wherein the juncture of two sides defines an acute angle capable of urging the spinning top onto the contact portion from another surface.

10. The apparatus of claim 8, further comprising means for retaining and storing tops.

11. The apparatus of claim 8, further comprising a dimple on at least one side of the contact portion.

12. The apparatus of claim 8, further comprising a dimple on a side of the handle portion contiguous with the at least one side of the contact portion.

13. The apparatus of claim 8, wherein the handle portion is constructed of material which is capable of causing the handle portion to glow.

14. A hand-held top toy apparatus, comprising:

a top, constructed of material which is capable of glowing; and a paddle configured for manipulating, catching, and throw the spinning top, the paddle including:

a handle portion; and a contact portion, connected to the handle portion, having a top side, a bottom side, a perimeter, and a ridge, disposed along at least a length of the perimeter of the top side, the ridge having terminal ends defining a gap adjacent the connection of the handle and the contact portion, whereby the spinning top may travel from the contact portion onto the handle portion.

15. The apparatus of claim 14, further comprising means for retaining and storing tops.

16. The apparatus of claim 14, further comprising a dimple on at least one side of the contact portion.

17. The apparatus of claim 14, further comprising a dimple on a surface of the handle portion contiguous with the top side of the contact portion.

18. The apparatus of claim 14, wherein at least one of the handle portion and the contact portion are constructed of material which is capable of glowing.

19. The apparatus of claim 14, further comprising an acute angle disposed around at least a portion of the perimeter, capable of urging a spinning top from another surface onto the top side of the contact portion.

20. The apparatus of claim 14, wherein the bottom side of the contact portion is substantially flat.

* * * * *